United States Patent [19]

Mackie

[11] 4,067,768

[45] * Jan. 10, 1978

[54] ALKALINE PULPING OF LIGNOCELLULOSIC MATERIAL WITH AMINE AND SULFATE PRETREATMENT

[75] Inventor: David M. Mackie, Vancouver, Canada

[73] Assignee: MacMillan Bloedel Limited, Vancouver, Canada

[ * ] Notice: The portion of the term of this patent subsequent to Aug. 30, 1994, has been disclaimed.

[21] Appl. No.: 806,677

[22] Filed: June 15, 1977

Related U.S. Application Data

[63] Continuation-in-part of Ser. No. 658,868, Feb. 17, 1976, Pat. No. 4,045,280.

[51] Int. Cl.[2] ..... D21C 1/06

[52] U.S. Cl. ..... 162/65; 162/72; 162/79; 162/84; 162/86; 162/90

[58] Field of Search ..... 162/63, 65, 70, 72, 162/79, 81, 82, 84, 86, 90

[56] References Cited

U.S. PATENT DOCUMENTS

| | | | |
|---|---|---|---|
| 1,163,438 | 12/1915 | Muller | 162/65 X |
| 1,860,431 | 5/1932 | Richter | 162/79 X |
| 2,192,202 | 3/1940 | Peterson et al. | 162/72 X |
| 2,218,479 | 10/1940 | Peterson et al. | 162/72 X |
| 2,511,096 | 6/1950 | Bate | 162/65 |
| 2,668,110 | 2/1954 | Spencer et al. | 162/72 X |
| 3,691,008 | 9/1972 | Worster et al. | 162/65 X |
| 3,695,994 | 10/1972 | Worster et al. | 162/65 |
| 3,736,224 | 5/1973 | Grayson et al. | 162/65 |
| 3,829,357 | 8/1974 | Thompson et al. | 162/65 X |
| 3,951,732 | 4/1976 | Sjostrom et al. | 162/65 |

*Primary Examiner*—Arthur L. Corbin

[57] ABSTRACT

A method is described for increasing the yield of pulp obtained from an alkaline pulping process. A lignocellulosic material, such as wood chips, is first pretreated with an aqueous solution containing from 0.1 to 10% by weight of monoethanolamine, methylamine or dimethylamine and from 0.01 to 1% by weight of copper sulfate or nickel sulfate at elevated temperature and pressure in a closed vessel. This pretreated material is then subjected to conventional alkaline pulping, preferably soda or two-stage soda-oxygen pulping.

10 Claims, No Drawings

ALKALINE PULPING OF LIGNOCELLULOSIC MATERIAL WITH AMINE AND SULFATE PRETREATMENT

BACKGROUND OF THE INVENTION a. Field of the Invention

This invention relates to an amine pretreatment for increasing the yield or quality of pulp obtained from an alkaline pulping process. It is a continuation-in-part of application Ser. No. 658,868, filed Feb. 17, 1976 now U.S. Pat. No. 4,045,280.

b. Description of the Prior Art

Until very recently, the only practical method for producing high strength chemical pump from lignocellulosic material such as wood chips, was by the old established kraft process. In this process, lignocellulosic material is cooked in an aqueous solution containing NaOH and $Na_2S$. This process, however, suffers from two disadvantages, namely a relatively low pulp yield, and odorous gas emissions — the latter arising from the use of sulfur compounds in the kraft cooking liquors. Both of these process aspects have become more critical in recent years with the rising production costs, raw material shortages, and the public pressures for a cleaner environment with less pollutive mill emissions. A number of methods for improving kraft pulp yield have been proposed, but the only processes of practical significance involve the use of sodium polysulfide as described in the text "The Pulping of Wood," R. G. MacDonald, Editor, McGraw-Hill, or $H_2S$ as described in Vinje and Worster, U.S. Pat. No. 3,520,773, issued July 14, 1970. Both of these process changes, however, do not avoid the use of sulfur in the kraft mill and consequently kraft mill odor remains a problem.

Practical methods to avoid the use of sulfur in chemical pulp mills have long been sought after by the Pulp and Paper Industry. The soda and recently discovered two-stage soda-oxygen processes are the only processes currently available for producing high quality chemical pulp without the use of sulfur. The soda process is little used because it produces pulp of lower yield and quaity compared to the kraft process. The soda-oxygen process, as described in Worster and Pudek, U.S. Pat. No. 3,691,008, issued Sept. 12, 1972, avoids these deficiencies, and produces a pulp of comparable yield and quality to the kraft process. It is a principal purpose of this invention to provide a method for pulping to even higher yields than the soda-oxygen or kraft processes without using sulfur-containing compounds.

It has also been known for many years that aliphatic amine compounds can be used as a pulping agent either alone or in combination with known alkaline pulping agents. As described in Peterson and Wise, U.S. Pat. No. 2,218,479, issued Oct. 15, 1940, a minimum of 15% by weight of the amine compound was required in the pulping liquor, with 70–100% being preferred. This apparently improves pulp yields and pulp quality.

SUMMARY OF THE INVENTION

According to the present invention, it has been found that even greater yield improvements can be obtained if both a water-soluble, lower aliphatic amine and a water-soluble, transition metal salt are used to pretreat lignocellulosic materials, followed by an alkaline pulping process.

Thus, the present invention provides a method for increasing the yield or quality of pulp obtained from an alkaline pumping process, in which lignocellulosic material is first pretreated with an aqueous solution containing from 0.1 to 10% by weight of a water-soluble, lower aliphatic amine and from 0.01 to 1% by weight of a water-soluble, transition metal salt, and the thus pretreated material is then subjected to an alkaline pulping process. The above percentages are by weight based on the dry weight of lignocellulosic material. This method particularly makes it possible to either further increase the yield at the same amine application or reduce the amine application significantly to give the same yield increase.

DESCRIPTION OF THE PREFERRED EMBODIMENTS

The amine used in the pretreatment is a water-soluble, low molecular weight aliphatic amine, e.g. having less than 6 carbon atoms, with monoethanolamine, methylamine and dimethylamine being particularly preferred.

As the transition metal, a variety of different ones are possible but copper and nickel have been found to be particularly preferred. For ease of preparation, a highly soluble salt is preferred with nitrates and sulfates being particularly suitable. It has also been found to be desirable in preparing the pretreatment solution to first combine the amine and metal ion solutions and thereafter add an alkali, such as sodium hydroxide.

The pretreatment is preferably conducted at elevated temperatures and pressure at a pretreatment solution to lignocellulosic material ratio of from 1:1 to 10:1. Best results are achieved at a temperature in the range of from about 80° to 180° C with a treatment time of about 5 to 120 minutes. Best results are also obtained if the pretreatment is conducted in a pressure vessel preferably at a pressure above the ambient steam pressure of about 0 to 200 psi. The latter pressure can conveniently be provided by an inert gas such as nitrogen which does not react substantially with the pretreatment chemicals.

It is also desirable to adjust the pH of the aqueous amine pretreatment solution to a cold pH in the range of 8 to 13 by addition of alkali. Preferably sodium hydroxide is added as alkali in an amount of from about 0.2 to 10% by weight based on the dry weight of lignocellulosic material. Sodium carbonate can also be used as the alkali. As mentioned above, the alkali is preferably added after the amine and transition metal have been combined in solution.

As an example of the advantages of the invention using only 0.05% nickel nitrate or copper nitrate and 7% monoethanolamine on chips, a yield increase of 7.5% over soda is attained at high Kappa number. This can be compared to a yield increase of 6.2% using the same conditions except for the omission of the transition metal salt. This is illustrated in Table I below:

TABLE I

| | | | |
|---|---|---|---|
| % Ni $(NO_3)_2$ based on original wood | 0.05 | 0.05 | 0.05 |
| % monoethanolamine pretreatment based on original wood | 7 | 5 | 3 |
| Yield increase over soda without metal salt in pretreatment stage, at ~130 Kappa No. | 6.2 | 5.1 | 2.0 |
| Yield increase over soda with metal salt in pretreatment stage, at ~130 Kappa No. | 7.5 | 6.6 | 3.5 |

The pretreatment of this invention has been found to be particularly effective in combination with soda and a two-stage soda-oxygen pulping process, since superior results are obtained with no environment damaging sulfur in the system. For example, if the monoethanolamine-transition metal ion pretreatment is combined with a soda-oxygen pulping scheme, a yield increase of 5.5% over soda-oxygen pulping at the same lignin content is obtained with a 7% monoethanolamine pretreatment. This is equivalent to a 9.5% yield increase over comparable soda pulp.

As a further example of the effectiveness of the present invention, it has been found that by using the transition metal salt in the pretreatment stage it is possible to obtain an equivalent yield increase while reducing the monoethanolamine application by up to about 3% based on wood. This is illustrated by the following Table II:

TABLE II

| | | | |
|---|---|---|---|
| % Monoethalanolamine in Pretreatment Stage | 7 | 4 | 4 |
| % Transition Metal, $Cu(NO_3)_2$ added to Pretreatment Stage | — | — | 0.05 |
| % Transition Metal, $Ni(NO_3)_2$ added to Pretreatment Stage | — | 0.05 | — |
| Yield Increase Over Soda | 6.2 | 6.3 | 6.1 |

At lower Kappa numbers the yield increase was not as significant, but the addition of the transition metal salt to 4% monoethanolamine pretreatment stage maintained a yield increase over soda at the same degree of delignification as pretreatment with 7% monoethanolamine without transition metal salt. This is illustrated by the following Table III:

Table III

| | | |
|---|---|---|
| % Monoethanolamine in Pretreatment Stage | 7 | 4 |
| % Transition Metal Salt, $Cu(NO_3)_2$ | — | 0.05 |
| % Yield Increase Over Soda at same Lignin Content | 4.2 | 3.9 |

It has been found that the quality of the high yield pulp obtained according to this invention is comparable to that of soda-oxygen or kraft pulps, and in particular has a very high unbeaten burst and tensile strength. This is illustrated by the following Table IV:

Table IV

| Strength Properties Unbeaten/500 CSF | Pretreatment Soda-Oxygen | Soda-Oxygen | Kraft |
|---|---|---|---|
| Burst Factor | 50/86 | 30/90 | 34/91 |
| Tear Factor | 156/91 | 280/108 | 316/126 |
| Tensile | 6.8/11.7 | 4.7/9.7 | 5.6/12.2 |
| Bulk | 2.04/1.50 | 1.97/1.49 | 2.05/1.47 |

Pulp having the above characteristics is excellent for linerboard and newsprint manufacture.

This pretreatment process can also be used prior to a kraft pulping stage to obtain a yield increase. Without the use of a transition metal salt, a yield increase of about 1% is obtained. However, when the transition metal salt together with amine is used in the pretreatment stage prior to kraft pulping, a yield increase of 3% is obtained. A faster pulping rate also results because of the pretreatment stage.

In the pretreatment, it has been found that pH and wood chip penetration of the pretreatment solution are important factors controlling the efficiency of the pulping process. Penetration factors are, of course, less important with other types of lignocellulosic raw materials such as sawdust, grasses, bagasse etc. To aid chemical penetration into the wood chips, the chips are first presteamed as in standard commercial practice, and an overpressure of an inert gas such as nitrogen is applied in the pretreatment stage. The use of gases other than nitrogen do not have a significant effect on the pulp yield.

In a typical mill procedure, wood chips are pretreated in a pressure vessel with a solution of monoethanolamine, methylamine or dimethylamine and copper nitrate or nickel nitrate at an amine application of about 5–10% by weight and a nitrate application of 0.01–1% by weight based on bone dry wood, together with about 0.5–3% NaOH on wood. The liquor to wood ratio is sufficient to saturate the chips and is typically about 4–5:1. Treatment temperatures are usually about 120°–160° C with treatment times of about 30–60 minutes. A convenient nitrogen pressure is about 25 psi. After the treatment, the chips are drained to recover unused amine and metal ions and the pretreated chips are subjected to a conventional pulping process.

Cooking conditions in the soda stage are typical of those employed in regular soda or soda-oxygen pulping schemes. Somewhat lower temperatures, in the range of 150° to 170° C, may be advantageously used in the soda stage of the soda-oxygen process, or in a soda cook where linerboard pulps with a high lignin content are required.

Pulping conditions used in the oxygen stage of the soda-oxygen process are typical of those detailed in prior art for the soda-oxygen process or oxygen bleaching processes. Typically, blow or mechanically defibered pulp from the soda stage is treated with NaOH (1 to 10% on pulp depending on consistency) in the presence of oxygen between about 100 and 200 psi and at temperatures between about 80° and 130° C for time periods of between about 30 and 200 minutes. Pulp consistency during the oxygen treatment may range from 3 to 30%, and the presence of magnesium 'protector' compounds may be required as specified in the prior art.

In a typical pulp mill operation, the pretreatment can be carried out in a separate vessel with chip transfer to the cooking vessel, or the pretreatment can be carried out in the same vessel ahead of the cooking stage. In a continuous digester, the pretreatment can be carried out in the pre-impregnation zone with co-current or counter-current flows of cooking and pretreatment liquors. Useful pretreatment compounds may also be recovered or regenerated for recycle from the spent cooking liquor (black liquor) by evaporation, steam stripping, liquid/liquid extraction, or lignin precipitation. Regenerated pretreatment compounds may also be prepared by reaction of compounds stripped from black liquor with ammonia. Overall amine consumption is between about 0.5 & 3% based on wood depending mainly on the particular amine used, and efficiency of its recovery from the black liquor.

Although the above discussion refers only to sodium based pulping processes, it is to be understood that potassium or ammonium based pulping systems are equally as amenable to the amine treatments of this invention.

Additional benefits that can be obtained through the pretreatments described in this invention are a more uniform and brighter unbleached pump. Compared to pulps prepared by the conventional soda process, pulps prepared by pretreatment always show a higher unbleached brightness and lower rejects or shive level at the same lignin content (or degree of pulping). These are important pulp quality considerations for linerboard and unbleached market pulp applications as well as from the aspect of easier bleachability. Bleaching yield from these pulps has been found to be exceptionally high compared to bleaching yield on conventional soda or kraft pulps. These results arise from the exceptional uniformity of these pulps and probably from the low degree of lignin condensation in the unbleached pulps. The ability of the pretreatments to improve pulp uniformity is also evident with the kraft pulping process. A pretreatment to the kraft process results in higher pulp yield as well as a more uniform pulp. Incorporation of amine in the pretreatment of the $H_2S$ pretreatment kraft process resulted in a pulp with no rejects at all. Improvement in pulp quality with respect to brightness, uniformity and bleachability are thus additional benefits that can be obtained through this invention.

The presence of an amine in the liquor system of a pulp mill also has the advantages of inhibiting corrosion and absorbing any trace of odorous acid gases such as $H_2S$.

The mechanism of the pretreatment system is not fully understood; however, it is thought that carbohydrates are partially stabilized in the pretreatment stage toward alkaline degradation in the cooking stage, through the formation of Schiff bases with the aldehydic end groups of wood polysaccharides, or perhaps through the formation of a reduced end group (J. Amer. Chem. Soc. 57;2554 (1935)). The presence of residual amine from the pretreatment stage in the soda cooking stage is thought to act as a radical scavenger thus restricting lignin condensation. The presence of condensed lignin requires more severe cooking conditions. preventing its decomposition and thus improving its efficiency.

The following examples will illustrate the various aspects of the invention described in this specification. Western hemlock commercial chips were used in all the examples except where otherwise specified. All pulping experiments were conducted in a 0.4 cu. ft. stationary digester with liquor circulation, on 2 lb. (bone dry) charges of wood chips. All cooks except where otherwise indicated were subjected to a 6-minute presteaming treatment at 15 psig. Liquor to wood ratio during pretreatments was normally 4.5 to 1.

EXAMPLE 1

Western hemlock wood chips were presteamed in the usual manner. Following presteaming, the chips were pretreated with an aqueous alkaline solution containing various amounts of amine and transition metal salt. The pretreatment was performed in the same 0.4 cu. ft. vessel as the subsequent soda cook with addition of nitrogen pressure of about 100 psi as measured at about 90° C after the presteaming treatment. On completion of the pretreatment, excess liquor was removed; chips were subjected to a short rinse which was removed prior to charging with soda cooking liquor.

Pretreatment and cook conditions together with results are set out in Table V. Much better yields are obtained when an equivalent addition of monoethanolamine with a transition metal salt is added to the pretreatment stage.

TABLE V

| Cook # | 1 | 2 | 3 | 4 | 5 | 6 | 7 |
|---|---|---|---|---|---|---|---|
| Pretreatment Conditions | | | | | | | |
| % MEA on wood | 7 | 7 | 5 | 5 | 5 | 3 | 3 |
| Liquor to wood ratio | 4.5/1 | 4.5/1 | 4.5/1 | 4.5/1 | 4.5/1 | 4.5/1 | 4.5/1 |
| % NaOH | 1.0 | 1.0 | 1.0 | 1.0 | 1.0 | 1.0 | 1.0 |
| % Copper Nitrate | — | 0.05 | — | 0.05 | — | — | 0.05 |
| % Nickel Nitrate | — | — | — | — | 0.05 | — | — |
| Max. Temperature, ° C | 140 | 140 | 140 | 140 | 140 | 140 | 140 |
| Time to Temp, minutes | 45 | 45 | 45 | 45 | 45 | 45 | 45 |
| Time at Temp, minutes | 60 | 60 | 60 | 60 | 60 | 60 | 60 |
| Digester Pressure at Temp, psig | 110 | 110 | 110 | 110 | 110 | 110 | 110 |
| Soda Stage Conditions | | | | | | | |
| Liquor to Wood Ratio | 4.5/1 | 4.5/1 | 4.5/1 | 4.5/1 | 4.5/1 | 4.5/1 | 4.5/1 |
| % NaOH on Wood | 16.5 | 16.5 | 16.5 | 16.5 | 16.5 | 16.5 | 16.5 |
| Max. Temperature, ° C | 165 | 165 | 165 | 165 | 165 | 165 | 165 |
| Time to Temp, minutes | 30 | 30 | 30 | 30 | 30 | 30 | 30 |
| Time at Temp, minutes | 70 | 70 | 70 | 70 | 70 | 70 | 70 |
| Results | | | | | | | |
| Kappa Number | 138 | 131 | 139 | 136 | 138 | 137 | 133 |
| % Yield | 62.2 | 62.4 | 61.1 | 62.3 | 62.8 | 57.9 | 58.6 |
| % Total Yield Increase Over Soda at Same Kappa Number | 6.2 | 7.5 | 5.1 | 6.6 | 6.8 | 2.0 | 3.5 |

It is believed that the metal ions combine with the amine to form chelates in the following manner:

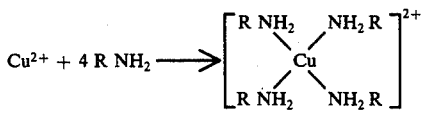

where R is a lower alkyl group. The chelate is believed to stabilize the amine during the pretreatment stage,

EXAMPLE 2

Following the same general procedure as set out in Example 1, a series of cooks were performed using methylamine and transition metal salt.

Pretreatment and cooking conditions together with results are set out in Table VI. These results indicate that methylamine can be used with the transition metal salt to obtain yield increases equivalent to monoethanolamine and transition metal salt.

TABLE VI

| Cook # | 8 | 9 | 10 | 11 |
|---|---|---|---|---|
| Pretreatment Conditions | | | | |
| Type of Amine | MEA | MEA | MA | MA |
| % Amine Applied on Wood | 4 | 4 | 4 | 4 |
| Liquor to Wood Ratio | 4.5/1 | 4.5/1 | 4.5/1 | 4.5/1 |
| % NaOH on Wood | 1.0 | 1.0 | 1.0 | 1.0 |

TABLE VI-continued

| Cook # | 8 | 9 | 10 | 11 |
|---|---|---|---|---|
| % Copper Nitrate Applied on Wood | 0.05 | 0.05 | 0.05 | 0.05 |
| Maximum Temperature, ° C | 140 | 140 | 140 | 140 |
| Time to Temperature, min | 45 | 45 | 45 | 45 |
| Time at Temperature, min | 60 | 60 | 60 | 60 |
| Digester Pressure at Maximum Temperature, psig | 175 | 178 | 169 | 177 |
| Soda Stage Conditions | | | | |
| Liquor to Wood Ratio | 4.5/1 | 4.5/1 | 4.5/1 | 4.5/1 |
| Temperature, ° C | 170 | 165 | 170 | 165 |
| Time to/at Temperature, min | 30/120 | 30/120 | 30/120 | 30/120 |
| % NaOH on Wood | 28.5 | 22 | 28.5 | 22 |
| Results | | | | |
| Kappa Number | 50.7 | 97.5 | 53.9 | 106.6 |
| % Total Yield on Wood | 46.2 | 55.8 | 46.9 | 56.6 |
| % Yield Increase Over Soda at Same Lignin Content | 4.8 | 6.3 | 4.9 | 6.2 |

EXAMPLE 3

Following the same general procedure as set out in Example 1, a series of pretreatments were performed using MEA and copper nitrate. This pretreatment was subsequently followed by a kraft pulping stage to give pulp of up varying Kappa number. The pretreatment and kraft cooking conditions are set out in Table VII. These results indicate that the combination of amine and transition metal salt pretreatment results in a yield increase over conventional kraft pulping at the same lignin content, without any significant loss in physical strength properties, Table VIII.

TABLE VII

| Cook # | 12 | 13 | 14 | 15 | 16 |
|---|---|---|---|---|---|
| Pretreatment Conditions | | | | | |
| Type of Amine | — | MEA | MEA | MEA | MEA |
| % Amine Applied on Wood | — | 7.0 | 7.0 | 7.0 | 7.0 |
| Liquor to Wood Ratio | — | 4.5/1 | 4.5/1 | 4.5/1 | 4.5/1 |
| % NaOH on Wood | — | 1.0 | 1.0 | 1.0 | 1.0 |
| % Copper Nitrate Applied on Wood | — | — | 0.05 | 0.1 | 0.05 |
| Max Temperature, ° C | — | 140 | 140 | 140 | 140 |
| Time to Temp, min | — | 45 | 45 | 45 | 45 |
| Time at Temp, min | — | 60 | 60 | 60 | 60 |
| Digester Pressure at Maximum Temperature, psig | — | 178 | 169 | 174 | 178 |
| Kraft Stage Conditions | | | | | |
| Liquor to Wood Ratio | 4.5/1 | 4.5/1 | 4.5/1 | 4.5/1 | 4.5/1 |
| Temperature, ° C | 170 | 170 | 170 | 170 | 170 |
| Time to/at Temperature | 90/120 | 90/120 | 90/120 | 90/120 | 90/120 |
| % $Na_2O$ on Wood | 17 | 17 | 17 | 17 | 12.8 |
| % Sulfidity | 20.8 | 20.8 | 20.8 | 20.8 | 20.8 |
| Results | | | | | |
| Kappa No | 36 | 29.7 | 26.7 | 27.9 | 82.2 |
| % Total Yield | 44.4 | 45.3 | 45.7 | 45.5 | 54.0 |
| % Yield Increase over Kraft at Same Lignin Content | — | 1.0 | 3.0 | 2.8 | 3.0 |

TABLE VIII

| Cook # | 12 | 15 |
|---|---|---|
| Freeness, ml CSF | 500/300 | 500/300 |
| Burst Factor | 94/98 | 82/90 |

TABLE VIII-continued

| Cook # | 12 | 15 |
|---|---|---|
| Tear Factor | 123/106 | 130/106 |
| Breaking Length, m | 11,800/12,500 | 10,950/12,000 |
| Density, g/cc | 0.716/0.741 | 0.694/0.733 |

EXAMPLE 4

Following the same procedure as set out in Example 1, a series of pretreatments were performed using methylamine as the amine component and four different transition metal salts. The salts were copper nitrate, nickel nitrate, copper sulfate and nickel sulfate.

Pretreatment and cooking conditions together with results obtained are set out in Table IX. These results indicate that copper sulfate and nickel sulfate can be used with the amine to obtain yield increases equivalent to copper nitrate and nickel nitrate and the amine.

TABLE IX

| COOK # | 17 | 18 | 19 | 20 |
|---|---|---|---|---|
| PRETREATMENT CONDITIONS | | | | |
| Type of amine | MA | MA | MA | MA |
| % amine applied on wood | 4 | 4 | 4 | 4 |
| % NaOH on wood | 1.0 | 1.0 | 1.0 | 1.0 |
| % copper nitrate | 0.5 | — | — | — |
| % nickel nitrate | — | 0.5 | — | — |
| % copper sulfate | — | — | 0.5 | — |
| % nickel sulfate | — | — | — | 0.5 |
| MAXIMUM TEMPERATURE, ° C | 140 | 140 | 140 | 140 |
| Time to temp., min. | 45 | 45 | 45 | 45 |
| Time at temp., min. | 60 | 60 | 60 | 60 |
| Digester pressure at maximum temp. psig., | 169 | 172 | 168 | 177 |

TABLE IX-continued

| COOK # | 17 | 18 | 19 | 20 |
|---|---|---|---|---|
| SODA CONDITIONS | | | | |
| Liquor to wood ratio | 4.5/1 | 4.5/1 | 4.5/1 | 4.5/1 |
| Temperature, ° C., | 170 | 170 | 170 | 170 |
| Time to/at temp, min. | 30/120 | 30/120 | 30/120 | 30/120 |
| % NaOH on wood | 28.5 | 28.5 | 28.5 | 28.5 |
| RESULTS | | | | |
| Kappa number | 53.9 | 55 | 54.5 | 53.2 |
| % total yield on wood | 46.9 | 48.0 | 48.2 | 47.1 |
| % yield increase over soda at same lignin content | 4.9 | 5.1 | 5.8 | 5.3 |

I claim:

1. In a process for pulping raw lignocellulosic material, the steps which comprise first pretreating the lignocellulosic material with an aqueous solution containing from about 0.1 to 10% by weight of a water-soluble, low molecular weight aliphatic amine selected from the group consisting of monoethanolamine and methylamine and from about 0.01 to 1% by weight of a water-soluble transition metal salt selected from the group consisting of copper sulfate and nickel sulfate at elevated pressure in a closed vessel and thereafter subjecting the pretreated lignocellulosic material to an alkaline pulping process in the absence of oxygen.

2. A process according to claim 1 wherein the alkaline pulping process is a soda process.

3. A process according to claim 2 wherein the digested lignocellulosic material is subjected to a second digestion with sodium hydroxide in the presence of an excess of oxygen.

4. A process according to claim 1 wherein the pretreatment is conducted at an amine/transition metal solution to lignocellulosic material weight ratio of from 1:1 to 10:1 at a temperature of 80° to 180° C for 5 to 120 minutes.

5. A process according to claim 4 wherein the pretreatment is conducted at a vessel pressure in excess of ambient steam pressure of up to 200 psi, the excess pressure being provided by an inert gas which does not react substantially with the pretreatment solution.

6. A process according to claim 5 wherein the inert gas in nitrogen.

7. A process according to claim 6 in which the aqueous pretreatment solution contains added alkali to adjust the cold pH to a value of between 8 and 13.

8. A process according to claim 7 in which the added alkali is sodium hydroxide, added in an amount of from 0.2 to 10% by weight based on dry lignocellulosic material.

9. A process according to claim 1 in which the lignocellulosic material is wood chips.

10. A process according to claim 9 in which the wood chips are soft wood chips.

* * * * *